United States Patent [19]

Bean

[11] Patent Number: 4,836,540

[45] Date of Patent: Jun. 6, 1989

[54] ROTATING RING GAME

[76] Inventor: Jeffrey W. Bean, 27 Minerva Ave., Sanford, Me. 04073

[21] Appl. No.: 198,452

[22] Filed: May 24, 1988

[51] Int. Cl.[4] ..... A63F 9/00

[52] U.S. Cl. ..... 273/1 G; 273/155

[58] Field of Search ..... 273/1 G, 155, 241, 271

[56] References Cited

U.S. PATENT DOCUMENTS 4,560,164 12/1985 Darling ..... 273/155

4,632,399 12/1986 Bern ..... 273/155

*Primary Examiner*—Anton O. Oechsle

[57] ABSTRACT

A two player game provides an assembly of components in modifiable form by the rotation and sliding of two handles, the handles being separated by a series of spaced individually rotatable game rings, each ring being covered with a unique pattern of selected indicia about its circumference. Means controlled by the handles permit the players to rotate selected rings to align selected indicia on adjacent rings. Spacer rings rigidly affixed to a center shaft separate the game rings and have structure interlocking them to each other within the neighboring game rings. The game rings having inwardly facing teeth which can be selectively actuated by a tab on the end of a handle extension when the handle is rotated. A series of cooperating spring clips held by portions of the spacer rings in engagement with and beneath said teeth, yieldingly resist turning of the game ring by the tab and a keyway in the handle guard limits rotation of the handle extension at each play to turn the game wheel only one step at a time. Ridges defined by internal structure of the spacer rings cooperate with projections on the ends of the handle extensions to index the movements of the extension to locate the actuating tab within a selected game ring.

11 Claims, 4 Drawing Sheets

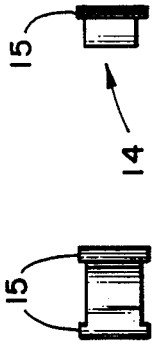
FIG. 8B
FIG. 8A
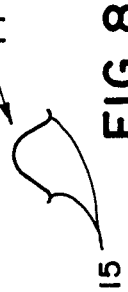
FIG. 8C
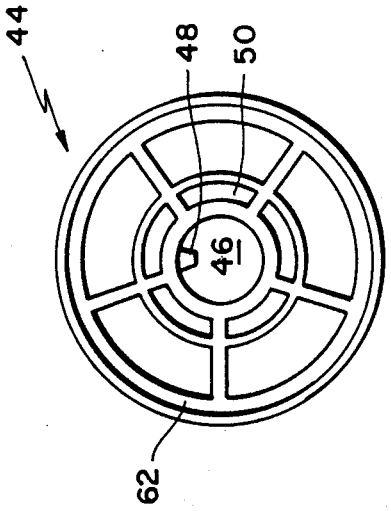
FIG. 6
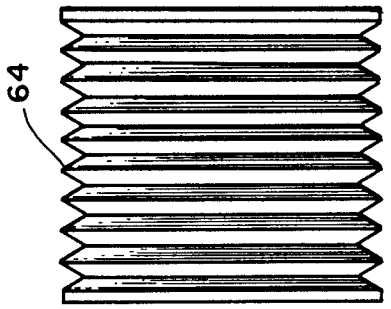
FIG. 7
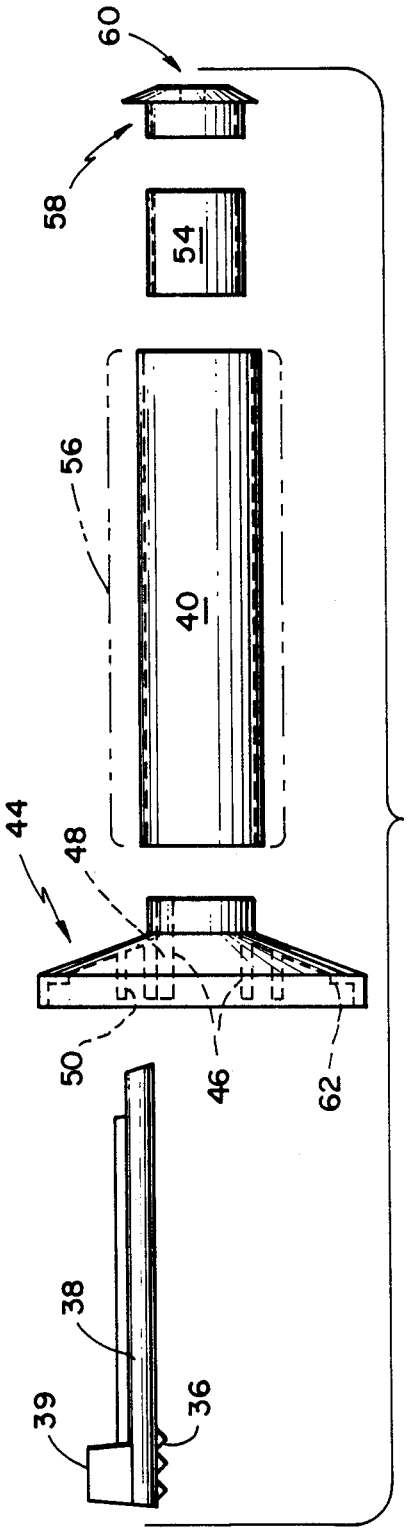
FIG. 5
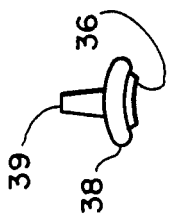
FIG. 5A

ROTATING RING GAME

BACKGROUND OF THE INVENTION

This invention provides a competitive rotating ring game device which permits two competitors, by rotating and sliding handles at opposite ends of a series of individually rotatable rings, to compete against each other for the purpose of aligning indicia, such as prechosen colors, spaced about the peripheries of the rings. It comprises a number of improvements on my prior U.S. Pat. No. 4,723,776, further facilitating the functioning, operation and manufacturing of the device of the invention.

SUMMARY OF THE INVENTION

The present invention comprises a series of side-by-side game rings which rotate about a central axis. The exposed cylindrical surface of each ring is covered by series of areas of different colors, shapes and/or design, being either printed, molded or similarly affixed. Each ring is unique as to the type of game involved, i.e., educational game (letters, numerals, etc.), competitive game and/or puzzle (swords, tanks, etc.) or simply selected colors. The game rings are controlled by two handles, one for each player, extending from opposite ends of the aligned series of rings. An extension of each handle comprising a ring actuating member having a ring actuating tab on its distal end extends axially within the series of rings from each handle and may be rotated and/or moved lengthwise in either direction by the handle. When the handle and extension are rotated the tab will engage and rotate by one step the game ring within which it is located at the moment. Correspondingly, when the handle is moved lengthwise in either direction the tab will be positioned to control a different game ring. Each player may, through his handle, control any one or two rings at any moment, except one then being controlled by his opponent. Thus, the player gains control of desired specific ring(s) by pushing or pulling his handle until the actuating tab has registered with the desired ring(s) whereupon he may rotate that ring by rotating the handle. Once the ring(s) is rotated, which may be step-by-step, he is ready to push or pull his handle to shift his actuating tab to another ring(s) in order to make another move.

The object of the game is to align the player's chosen color(s), shape(s) or design(s) in an axial direction over the playing surface before his opponent does likewise. It should be noted that the object of the game can be unique to each specific version of the game.

BRIEF DESCRIPTION OF THE DRAWINGS

FIG. 5A is an exploded side view of one handle assembly showing the various parts thereof;

FIG. 5B is an end view of the handle extension as shown at the left side of FIG. 5A.

FIG. 6 is an elevational view of one of the two handle guards;

FIG. 7 is a plan view of one of the two resilient rubber boots which permit the reciprocal and twisting motion of each handle while concealing the working parts;

FIGS. 8A, B and C display, respectively, plan, side and profile views of one of the spring clips employed in assembling the device to assist in the control of the stepwise rotary motion of the rings.

DETAILED DESCRIPTION OF PREFERRED EMBODIMENT

Figure 1A:
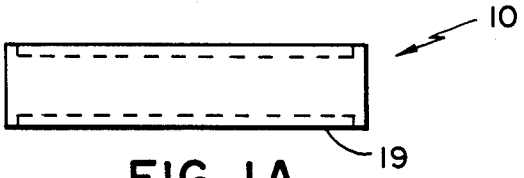
FIGS. 1A, B and C display, respectively, edge, elevational and cross-sectional views of one of the rotating game rings employed in a presently preferred embodiment of the invention.
Figure 1B:
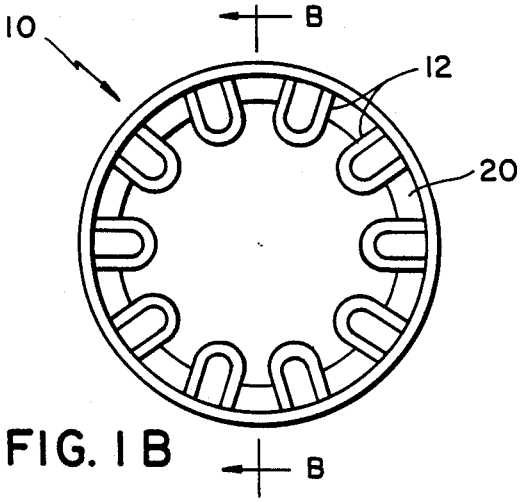
Figure 1C:
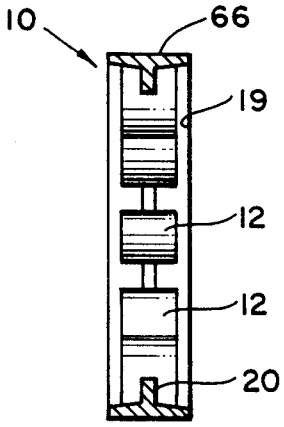
Figure 3:
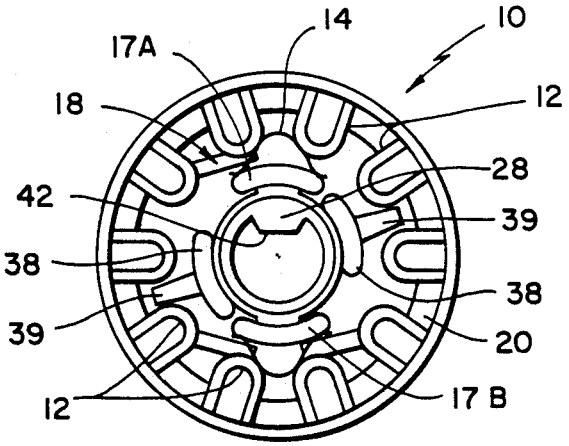
FIG. 3 is an elevational view of a game ring with internal parts shown in assembled condition.

From the three views of FIGS. 1A–C, the configuration of one of the rotatable game rings 10 is apparent. Any number of these rings, within reason, may be assembled side-by-side, as will later be explained, on the center shaft 30 (FIGS. 4A–B), depending on the version of the game. The game ring 10 can be made by an injection molding process. It is provided with a circular array of radially inwardly directed molded teeth 12, in this case ten, but any number of teeth may be used depending on the version of the game, i.e. how many different spaces 66 (FIG. 9) are to appear on the peripheral surface of each ring to be alinged by the players. The number of teeth determines the arc through which the rings can be turned to the left or right at each play. The teeth 12 are rounded so as to accept the spring clips 14 (as seen in FIG. 3). The teeth 12 of each game ring 10 are recessed axially inwardly as indicated at 19. The circular array is recessed slightly less than one-half the thickness of the stationary ring so as to allow a slight gap between the game ring array when the rings and spacers 18 are assembled to prevent their binding against each other. Ridge 20 on the game ring 10 is added to strengthen the part.

Figure 2C:
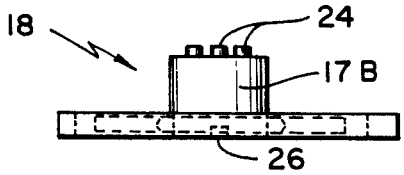
FIGS. 2A, B and C display, respectively, elevational, cross-sectional and edge views of one of the spacer rings which separate the game rings from each other.
Figure 2A:
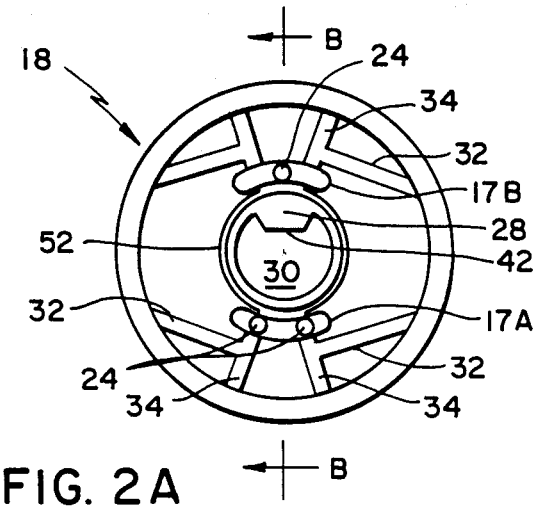
Figure 2B:
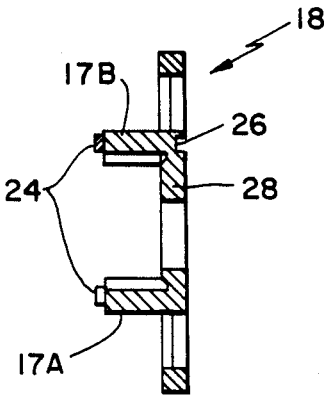

Referring to FIGS. 2A–C, it will be seen that each spacer ring 18 may be made in one piece by injection molding. As already mentioned, these interfitting stationary spacer rings separate the rotating rings 10 from each other and are so dimensioned in an axial direction as, when assembled, to allow the rings 10 to rotate freely and independently. These spacer rings connect together, when assembled, into one continuous chain by inserting studs 24 into corresponding holes 26 of the next spacer ring. Two studs 24 are formed on portion 17A of each ring and one stud 24 on portion 17B.

Figure 4A:
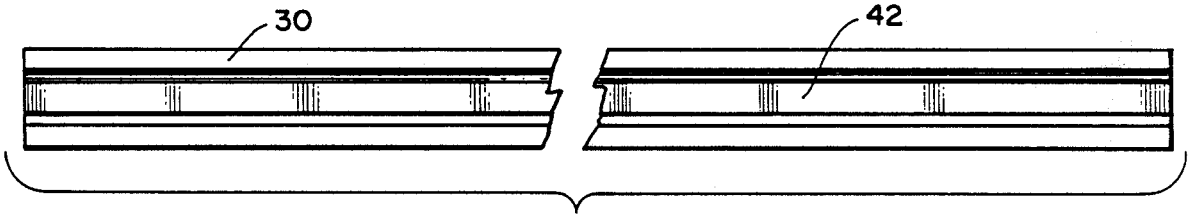
FIGS. 4A and B display, respectively, plan and end views of the main center shaft of the device about which the rings are assembled.
Figure 4B:
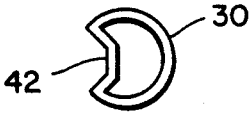

A radially inwardly extending extension 28 within each spacer 18 fits longitudinal groove 42 of central shaft 30 (FIGS. 4A–B) whereby all the spacer rings can be aligned for sliding onto and ridgedly attaching the spacers to the shaft once the rotating rings and spring clips are in place (FIGS. 3 and 4A–B).

Structural members 32, 34 strengthen the spacers and allow for efficient molding. Structural members 34 serve an additional function, that of providing a stop, limiting movement of the spring clips 14 in the axial direction. Center ring 52 of each spacer is present not only to provide a stronger part, but, more importantly, to define an axially spaced aligned series of internal radially outwardly facing ridges (FIG. 9) for receiving and accurately positioning the radially inwardly facing ridges 36 formed opposite the actuating tab 39 at the inner end of handle extension 38 (FIG. 5A). This simplified and greatly improved construction replaces the ball and guide positioning assembly of my U.S. Pat. No. 4,723,776.

Turning to FIG. 3, a spacer ring 18, game ring 10 and spring clips 14 are shown assembled. The spring clip 14 essentially free floats, engaging between the spacer 18 and the teeth 12 of the rotating ring 10. The engagement of tab 39 of each handle extension 38 with the teeth 12 is can be seen.

The center shaft itself 30 is illustrated in FIGS. 4A–B). It can be molded in one piece in an extrusion process. The longitudinal groove 42 covers an arcuate distance twice that which separates the teeth 12 of ring 10. For example, teeth 12 are arcuately spaced every 36°. Hence, in this case, the center shaft groove would cover a 72° arc. This relationship is important to the functioning of the game for it permits the proper left and right rotation of the two handles. Also the rotating ring assembly is assembled with radially inward extensions 28 of spacers 18 in alignment to be slid into this groove.

Turning now to FIG. 5A, there is shown an exploded side view of one of the two identical handle assemblies. Each is comprised of five components. The first of these is integrally molded handle guard 44. It is the piece on which the rest of the assembly is assembled. To receive the shaft 30 it has an opening 46 which is slightly larger than the diameter of the center shaft 30. The opening 46 is also provided with an internal keyway 48 covering the same arcuate distance as that which separates teeth 12. This allows the handle and, accordingly the rings 10, to rotate one interval at a time to the left or right, the spring clips 14 snapping into place and holding the teeth 12 until another move is made. A bore 50 in handle guard 44 is set 90° to the keyway 48 to receive handle extension 38.

Each handle extension 38 is molded of a suitable resilient plastic in an injection mold. While relatively rigid, this part is sufficiently flexible to bend when the two players have engaged the same rotating ring 10 but to spring back to its original position when the ring has been disengaged. The selection of suitable plastic is within the skill of the art.

Handle extension 38 carries tab 39 (FIG. 5B) which engages the teeth 12. Opposite tab 39, as mentioned above, three ridges 36 are formed on extension 38, so spaced and sized as to cooperate with rings 52 of the spacers 18 to locate the linear positions of the tab extension within the ring assembly properly with respect to whichever rotating ring or rings 10 the player wishes to engage. As the extension is reciprocated, these ridges ride over and snap into place over the rings 52 as seen in the cutaway view of FIG. 9 for properly positioning the handle assembly in use.

The system just described replaces the ball and guide assembly of my U.S. Pat. No. 4,723,776. The ridges 36 and ring 52 are shown having 30° bevels, but several other configurations could be used, such as rounds, within the discretion of the designer.

The handle 40 (FIG. 5A) is also made in an extrusion process. It is a simple tube of such a diameter as to be press-fitted and glued onto handle guard 44. A foam rubber grip 56 is slid onto the handle. It may be of the bicycle grip variety for comfort and appearance. The assembled handle guard 44, handle extension 38 and handle 40 can be slid onto the center shaft 30 before the handle stop 54 is pressed and glued onto the end of center shaft 30. The handle assembly itself is then free to slide back over the handle plug 58 until the end of the handle guard 44 hits the end of handle stop 54. This prevents the handle assembly from coming off the shaft 30 and also stops the assembly in the proper position for tab 39 to engage the end-most rotating ring 10. Handle plug 58 is then glued into the end of handle 40. A bore 60 in the end of the plug 58 permits attachment of a strap to encircle the player's wrist while playing the game.

Turning to FIG. 6, an end view of the handle guard 44 is shown. The relationship of keyway 48 to core hole 50 can be seen. One end of the rubber boot 64 shown in FIG. 7 is attached to flat 62 on guard 44. The other end of the rubber boot is attached to an outermost spacer 18 by gluing or by means of another small retaining ring on the inside (not shown). The boot 64 may thus yield flexibly in torsion and compress and expand axially with rotational and reciprocating movements of the handle guard 44.

Three views of the spring clip 14 are shown in FIGS. 8A, B and C, respectively. The clip 14 is used to retain the rotating rings 10 in their proper adjusted positions as shown in FIG. 3. The clips 14 may be metal, stamped out in a metal stamping process, or possibly resilient plastic formed by injection molding. Tabs 15 hold the spring clips 14 onto structural members 34 of the spacing rings 18. The convex side of the clips rest on portions 17A and 17B of the spacer rings (FIG. 3). As a rotating game ring 10 is rotated one step to the left, the tabs on the right side of the spring clip hold the clip in place while the rest of the clip is flexed to the left and downwardly (as seen in the upper portion of FIG. 3) to clear the tooth 12 of the rotating ring. Once the tooth is past the spring clip, the latter snaps and forces itself back into its normal position thereby holding the just rotated gask disk in its new position.

Figure 9:
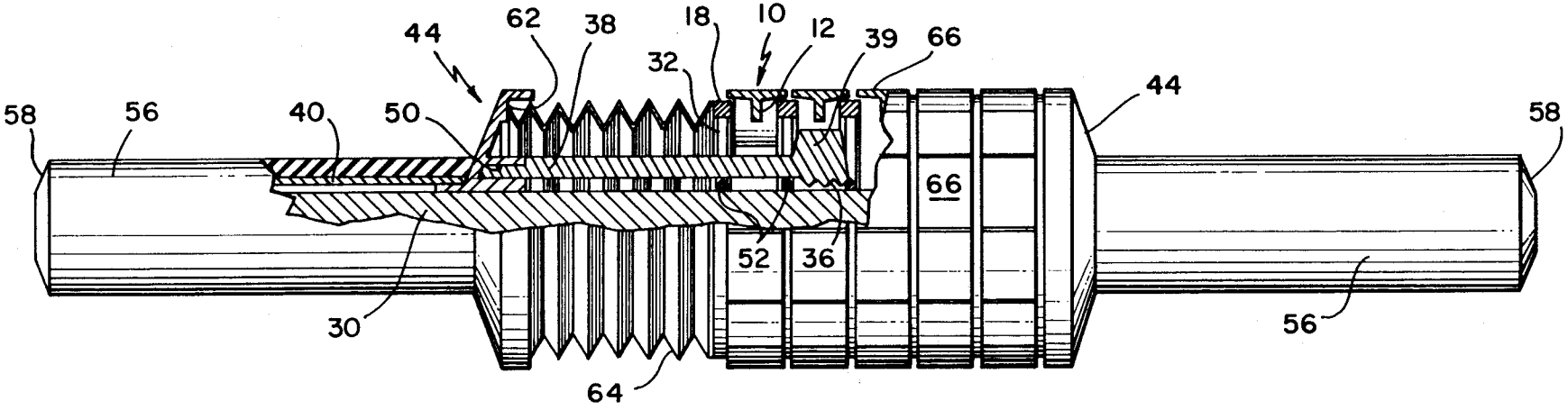
FIG. 9 is a plan view, with portions cut away, showing the parts assembled together in a complete unit.

An assembled cutaway view of the game device is shown in FIG. 9, disclosing the relationship of the assembled components. The surfaces of the rotating game rings may be divided into any number of spaces 66 and any number of icons may be displayed. Also any number or size of rings may be used depending on the version of the game. The basic functioning and assembly of the game would remain the same.

While there has herein been disclosed and described a presently preferred embodiment of the novel game, it will nevertheless be understood that the same is susceptible of modification and change by those skilled in the art and, therefore, it is intended the scope of the invention be limited only by the proper interpretation of the appended claims.

I claim:

1. In a two player game combining an assembly of components in modifiable form by the rotation and sliding of two handles, said handles being separated by a series of equally spaced rotating game rings, each ring being covered with a unique pattern of selected indicia about its circumference, means for rotating selected ones of said rings to align selected ones of said indicia on adjacent rings by the pushing, pulling and rotating said handles about a center shaft on a central common axis, each rotating ring being free to rotate about its axis and held secure by a series of stationary spacer rings ridgedly connected to said center shaft, the improvement wherein said spacer rings are provided with means for interlocking them to each other within the neighboring game rings so as to retain said game rings in position, said spacer rings being so dimensioned as to be non-binding with said game rings to permit free rotation thereof.

2. The game of claim 1 including.

a series of rounded, inwardly facing teeth spaced about the interior of each game ring, a series of cooperating spring clips held by portions of said spacer rings in engagement with and beneath said teeth, a handle extension extending within said assembly from each end for rotation and reciprocation with said handle, an actuating tab on the end of each extension in driving relation to the teeth of said game ring for rotating the same one step at a time when its handle is turned against the yielding of said spring.

3. The game of claim 2 wherein each of said handles comprises a rotatable and reciprocable handle guard, said guard having a keyway, said handle extension being held in said guard through said keyway for reciprocation and rotation limited by said keyway therewith and said keyway having an arcuate dimension equal to that between said teeth and means permitting said handle and handle extension to move backward and forward within said game assembly a sufficient distance so that said actuating tab may be moved to actuating position within all of said game rings.

4. The game of claim 2 wherein said spacer rings are provided with internal structure defining a spaced series of internal radially outwardly facing ridges and said handle extensions are provided with a series of cooperating inwardly facing projections opposite their actuating tabs which, when the extension is moved endwise within the game assembly, coact with said ridges to index said tab within a selected game ring.

5. The game of claim 4 wherein said ridges and projections are shaped to slope at the same angle as each other.

6. The game of claim 2 wherein each said spring clip is shaped to provide a curved body portion to fit between and in engagement with the sloping surfaces of adjacent teeth of a game ring and further to provide reversely turned tabs at its four corners to engage internal structure of adjacent spacer rings thereby to be retained by said structure during flexing when said game ring is rotated one step in either direction by said actuating tab of said handle extension.

7. The game of claim 3 wherein each of said handles comprises a central cylindrical member affixed to an end of said center shaft and a sleeve slidable thereover attached to and movable with said handle guard and wherein a stop is provided to prevent said sleeve and guard assembly from being removed from the said shaft, said sleeve being of such a size as to allow said handle assembly freely to slide back and forth over said central member.

8. The game of claim 3 further comprising a flexible boot mounted between each end spacer ring and the adjacent handle guard whereby said rubber boot while concealing the internal mechanism is free to expant and contract and flex torsionally when said handles are in operation rotating and reciprocating said handle extensions to manipulate said game rings.

9. The game of claim 1 wherein said interlocking means comprise mating studs and sockets on said internal structure extending from one spacer ring to the other through the openings in adjacent game rings.

10. The game of claim 9 wherein said central shaft is provided with a longitudinal external groove and the internal structure of each spacer ring is provided with a radially inwardly extending projection adapted to fit said groove, whereby, when the spacer rings are in alignment with their said projections in said groove, said spacer rings are rigidly affixed to said shaft.

11. The game of claim 10 wherein said longitudinal groove on said center shaft covers twice the arcuate distance of the keyway in said handle guard.

* * * * *